US006722736B2

(12) United States Patent
Guillot

(10) Patent No.: US 6,722,736 B2
(45) Date of Patent: Apr. 20, 2004

(54) MOVABLE SWITCH FOR A MOTORIZED RECLINER

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 43 days.

(21) Appl. No.: 10/080,224

(22) Filed: Feb. 21, 2002

(65) Prior Publication Data

US 2003/0155799 A1 Aug. 21, 2003

(51) Int. Cl.[7] ..... A47C 1/02

(52) U.S. Cl. ..... 297/330; 297/316; 297/340; 297/85

(58) Field of Search ..... 297/85, 463.1, 297/330, 316, 340; 200/85 A, 293, 294, 296

(56) References Cited

U.S. PATENT DOCUMENTS

| | | | | |
|---|---|---|---|---|
| 2,636,950 | A | | 4/1953 | Boadway |
| 3,178,522 | A | * | 4/1965 | Passarelli, Jr. |
| 3,639,709 | A | | 2/1972 | Hart et al. |
| 3,729,751 | A | | 5/1973 | Kirkman |
| 3,757,063 | A | | 9/1973 | Hart et al. |
| 3,812,313 | A | | 5/1974 | Wolf et al. |
| 3,832,503 | A | | 8/1974 | Crane |
| 3,894,206 | A | | 7/1975 | Suzuki et al. |
| 4,007,960 | A | | 2/1977 | Gaffney |
| 4,211,905 | A | * | 7/1980 | Quigley |
| 4,534,077 | A | | 8/1985 | Martin |
| 4,620,077 | A | | 10/1986 | Zdanys, Jr. et al. |
| 4,707,027 | A | | 11/1987 | Horvath et al. |
| 4,786,107 | A | | 11/1988 | Crockett |
| 4,827,093 | A | * | 5/1989 | Strzodka |
| 4,970,446 | A | | 11/1990 | Yaguchi |
| 5,024,486 | A | | 6/1991 | Auel |
| 5,029,939 | A | | 7/1991 | Smith et al. |
| RE33,675 | E | | 8/1991 | Young |
| 5,052,065 | A | | 10/1991 | West |
| 5,115,109 | A | | 5/1992 | Fisher |
| 5,290,981 | A | | 3/1994 | Yuda |
| 5,319,813 | A | | 6/1994 | DiMatteo et al. |
| 5,390,852 | A | | 2/1995 | Schuenemann et al. |
| 5,473,313 | A | | 12/1995 | Graebe, Jr. |
| 5,483,853 | A | * | 1/1996 | Moradell et al. |
| 5,497,676 | A | * | 3/1996 | Barnard |
| 5,540,479 | A | | 7/1996 | Thomas et al. |
| 5,748,473 | A | | 5/1998 | Breed et al. |
| 5,875,886 | A | | 3/1999 | Elster |
| 5,918,696 | A | | 7/1999 | VanVoorhies |
| 5,931,532 | A | | 8/1999 | Kemmerer et al. |
| 5,957,491 | A | | 9/1999 | Cech et al. |
| 6,019,429 | A | | 2/2000 | Tedesco |
| 6,021,863 | A | | 2/2000 | Stanley |
| 6,039,344 | A | | 3/2000 | Mehney et al. |
| 6,056,079 | A | | 5/2000 | Cech et al. |
| 6,092,838 | A | | 7/2000 | Walker |
| 6,106,065 | A | | 8/2000 | Carroll |
| 6,113,139 | A | | 9/2000 | Heximer et al. |
| 6,152,529 | A | | 11/2000 | Beason |
| 6,338,531 | B1 | * | 1/2002 | Hausherr et al. |

* cited by examiner

*Primary Examiner*—Milton Nelson, Jr.
(74) *Attorney, Agent, or Firm*—Alston & Bird LLP

(57) ABSTRACT

A position controller for controlling a motorized, reclining chair comprising a track attached to a frame of the chair and a controller switch slidable in the track. The reclining chair includes a motor that controls movement of a backrest of the chair into a reclining position and extension of a footrest of the chair into an extended position. The controller switch is slidable in the track so that it remains within reach of the user throughout the range of motion of the reclining chair. The position controller also includes a pressure switch that activates the control switch in response to loading of the seating area of the recliner, so that the motorized chair can be operated only by a seated user. The control switch includes a toggle switch that the user can easily manipulate by hand to control movement of the chair.

13 Claims, 8 Drawing Sheets

MOVABLE SWITCH FOR A MOTORIZED RECLINER

FIELD OF THE INVENTION

The present invention relates to the field of motorized furniture, and more particularly, controllers for motorized furniture.

BACKGROUND OF THE INVENTION

Reclining chairs, loveseats, and sofas are well known in the art and have become a mainstay in many households. Manual recliners typically utilize a lever or handle extending along one side of the recliner, such as a reclining chair, which releases an ottoman or footrest from the front of the chair and allows the chair to be reclined into a more prone position. Some amount of force must be exerted upon the lever to recline the chair. Likewise, another force must be exerted on the lever to bring the chair back to the original position. Disadvantageously, these manually-actuated chairs can be difficult to use for certain users, such as the elderly or physically impaired.

More recently, motorized devices have been developed that provide powered movement of a chair or the like. Motorized recliners have also been developed that allow the recliner to be adjusted into many reclined positions. U.S. Pat. No. 4,786,107 to Crockett discloses an apparatus for elevating and lowering an entire free standing and pre-existing seating structure, such as a house chair, recliner or sofa. In particular, the lift apparatus 20 includes an elevator means 34, a power means 44, and a control means 46. In operation, a user presses the control means or switch 46 that is secured adjacent to the armrest of the seating structure and that is connected to an electric motor 92. The switch 46 can start or stop the movement of the elevator means 34 in either direction, up or down, at any point in the range of travel of the elevator means so that the user can lower or raise themselves from the seating structure.

Motorized recliners increase consumer comfort along with safety and convenience. However, both the manual and powered recliners share similar problems, particularly regarding use by the elderly or physically impaired. More specifically, these users may have difficulty reaching or operating the lever or power controller as the recliner is set to a more reclined positions, in which the user is moved away from the armrests. Because the lever or power controller is typically located on an armrest, the user may recline to a position in which the user has difficulty reaching or is unable to reach for operation of the lever or controller. To overcome these problems, some motorized recliners provide a power controller attached to a cord so that the user can hold the power controller while adjusting the recliner to the desired position. However, the user may drop the power controller and thus be potentially trapped in a prone position. In addition, the controller cord creates clutter and an undesirable aesthetic appearance.

It would be advantageous to have a controller for a motorized recliner that is easily reachable by a user in a variety of reclined positions. It would be further advantageous if the appearance of the controller were aesthetically pleasing and did not create clutter. It would also be advantageous if the controller could not be dropped out of reach while the user is in a prone position.

SUMMARY OF THE INVENTION

The present invention addresses the above needs and achieves other advantages by providing a position controller for controlling a motorized chair comprising a track attached to a frame of the chair and a switch slidable in the track. The switch is slidable in the track so that it remains within reach of the user throughout the range of motion of the reclining chair. The position controller also includes a pressure switch that activates the position controller in response to loading of the seating area of the recliner, so that the motorized chair can be operated only by a seated user. In another aspect, the position controller preferably includes a toggle switch that the user can easily manipulate by hand to control the movement of the chair.

In one embodiment, the present invention includes a motorized chair having user-supporting surfaces that are movable relative to each other and are controllable by a user sitting on the chair. The chair comprises a frame, a motor and a position controller. The frame supports at least two user-supporting surfaces that are moveable relative to each other for positioning the user across a range of motion. The motor is connected to the fame and is capable of moving the user-supported surfaces. The position controller controls the motor and includes a track and a switch. The track is supported on the frame. The switch is connected to the motor and is supported in the track at a position reachable by the user. The switch is slidable in the track so that the switch remains within reach of the user throughout the range of motion as the user-supported surfaces of the chair are moved relative to each other.

In another aspect, the motorized chair includes a pressure switch that is connected to the position controller. The pressure switch is responsive to loading of one user-supporting surface by activating the position controller. The pressure switch is also responsive to unloading of one user-supporting surface by deactivating the position controller.

In yet another embodiment, the at least two user-supporting surfaces comprise a back supporting surface, a seat supporting surface and a footrest supporting surface. In another aspect, the chair includes upholstery covering the frame and surrounding a periphery of the track.

In another aspect, the track is supported on the frame in a horizontal orientation. The horizontal orientation is parallel to an armrest of the chair. In another embodiment, the switch of the position controller is a toggle switch that can be easily manipulated by hand.

The present invention has several advantages. The user can reach the switch throughout a range of reclining positions, which prevents the user from becoming stuck in a prone position in the chair. The controller has a low, unobtrusive profile which is aesthetically pleasing, especially when surrounded by an upholstered surface. As the frame supports the track, the controller cannot be dropped or misplaced. The toggle switch can be manipulated by hand and requires little exertion, which is ideal for elderly or disabled users. The pressure switch avoids accidental movement of the chair when the weight of the user is not applied to one of the seating surfaces.

BRIEF DESCRIPTION OF THE DRAWINGS

Figure 1:
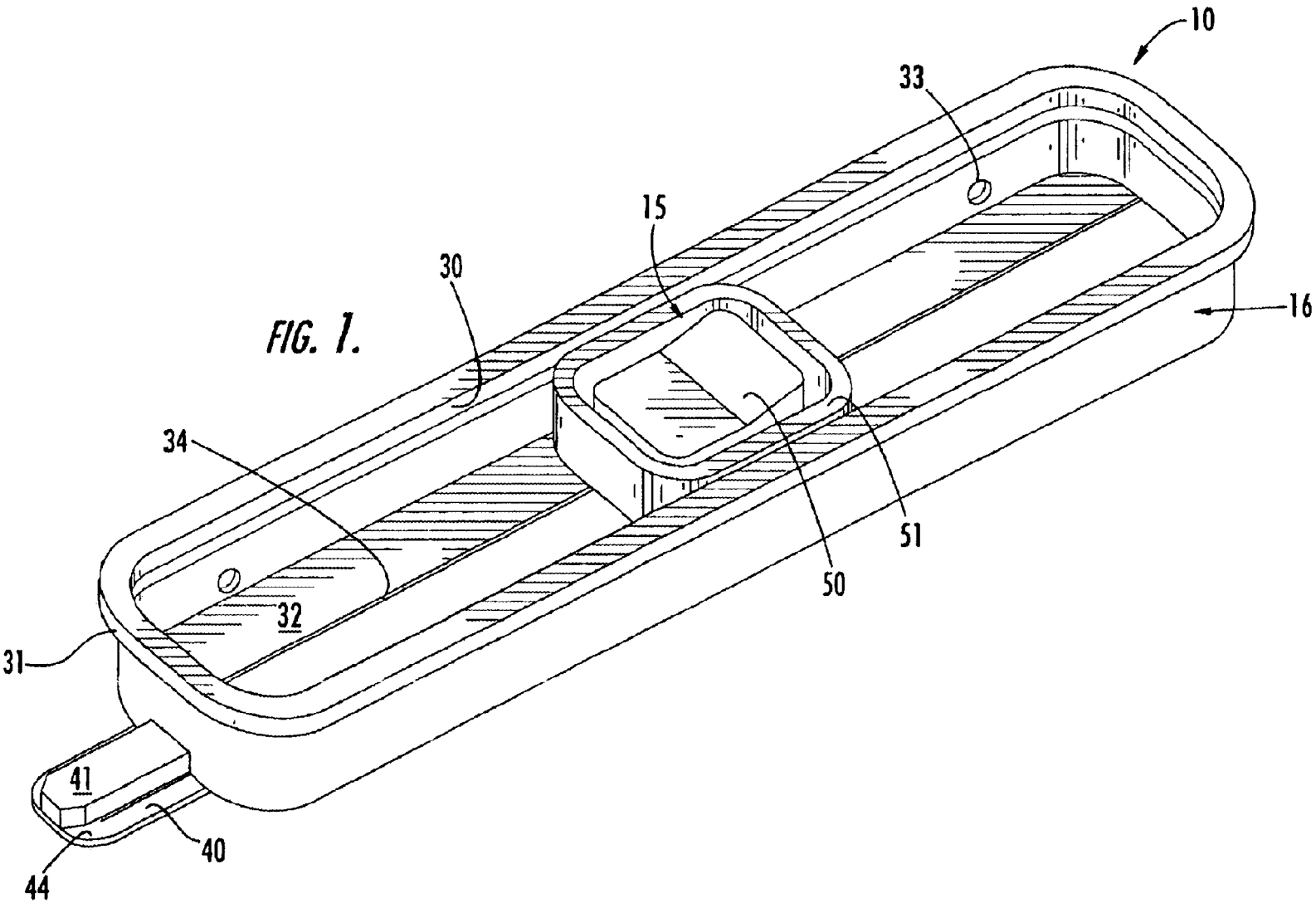
Figure 2:
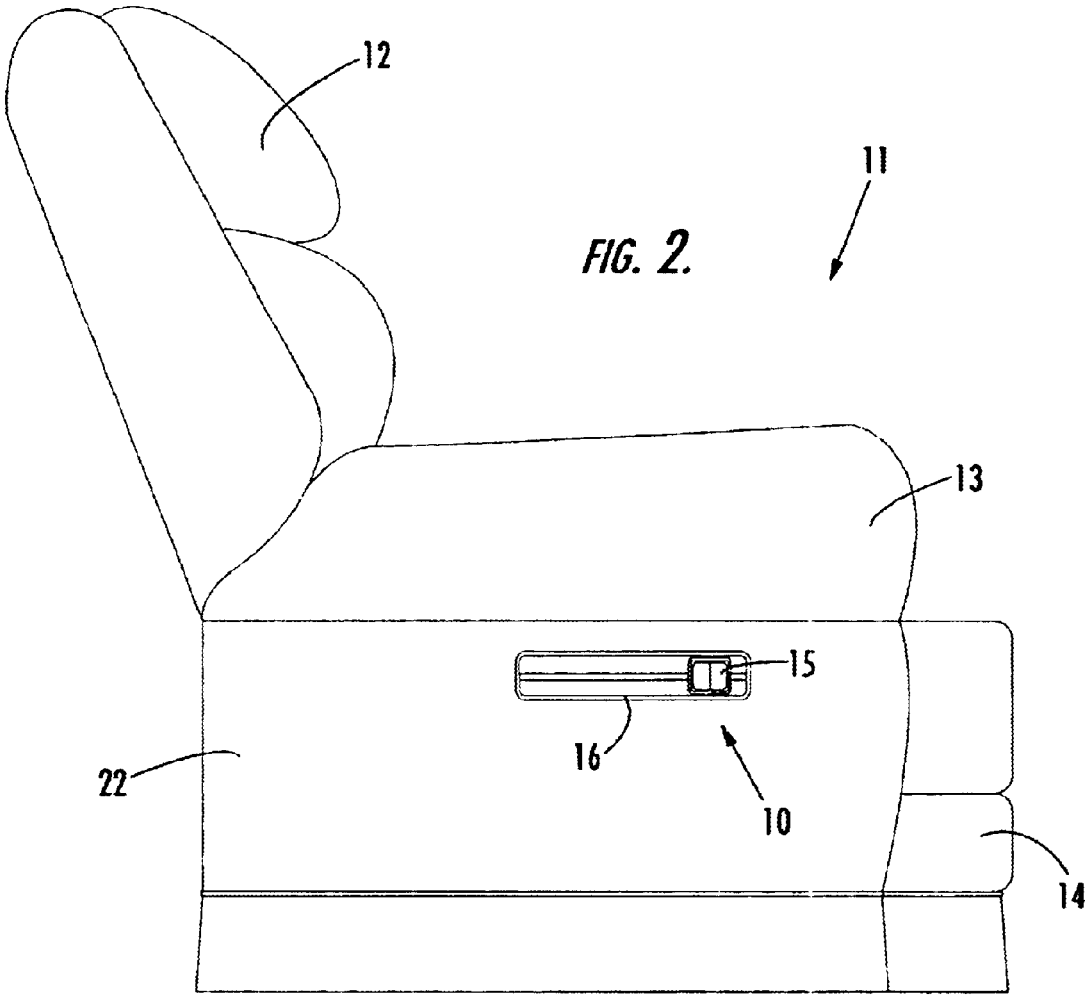
Figure 3:
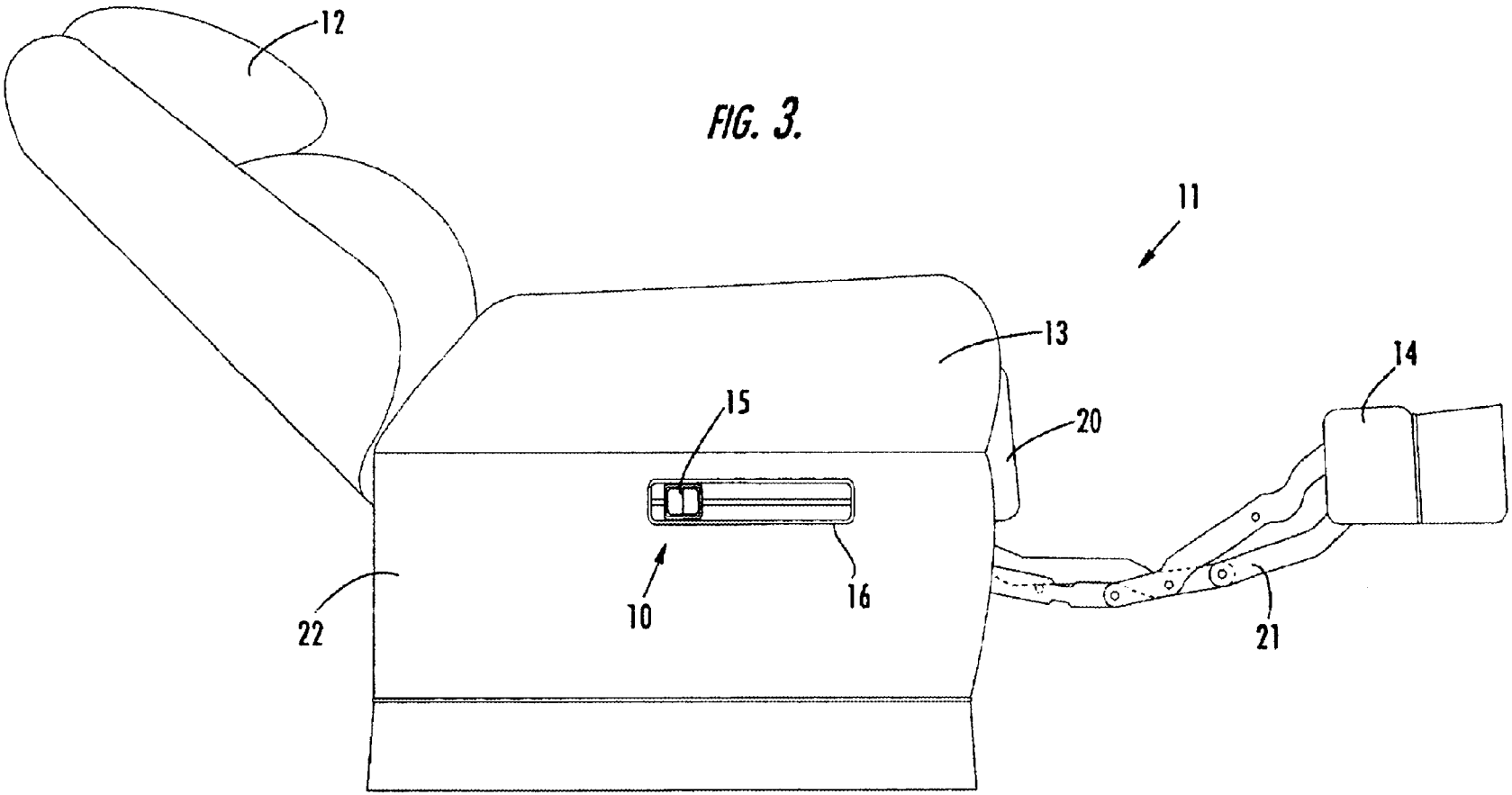
Figure 4:
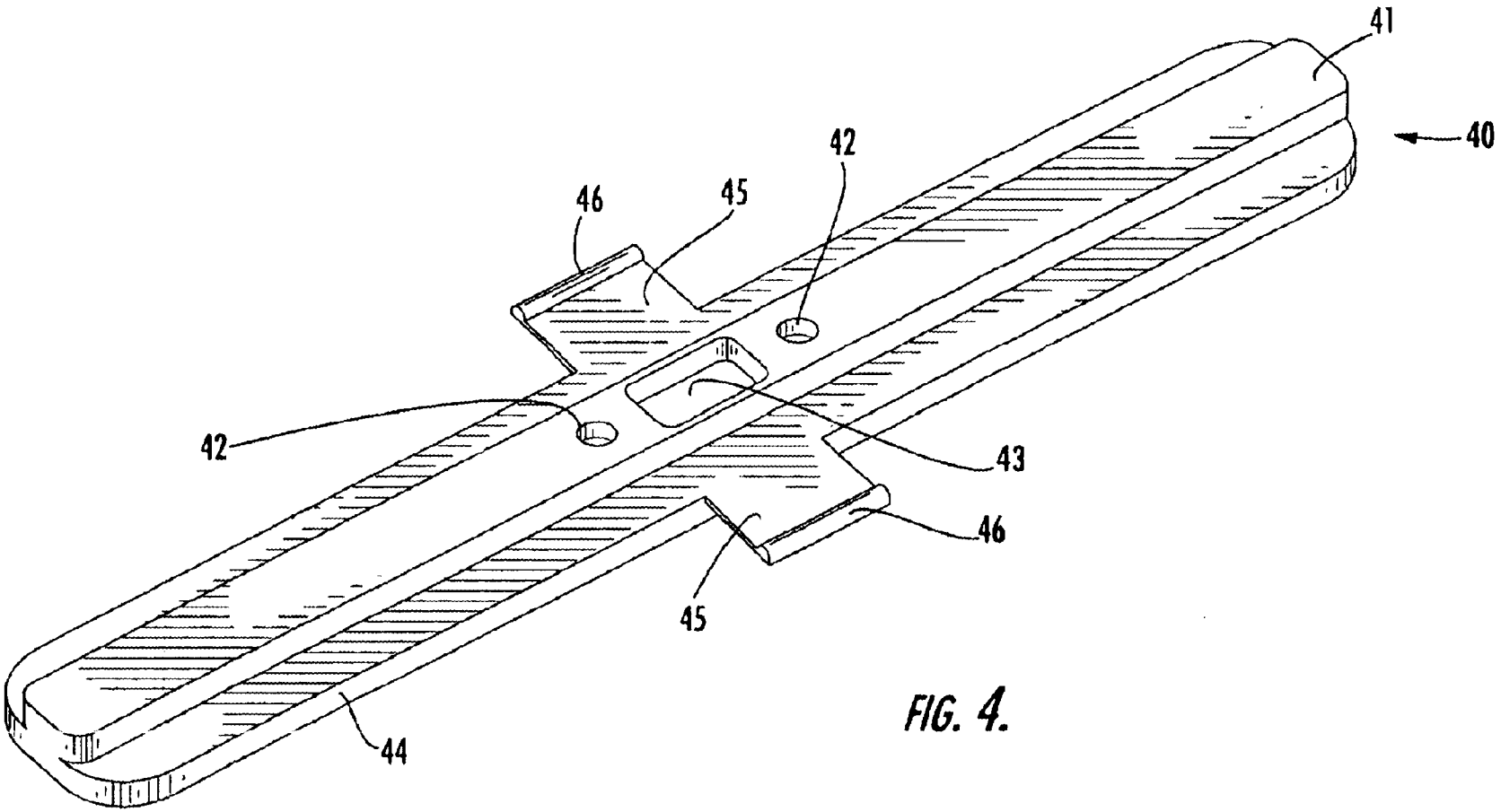
Figure 5B:
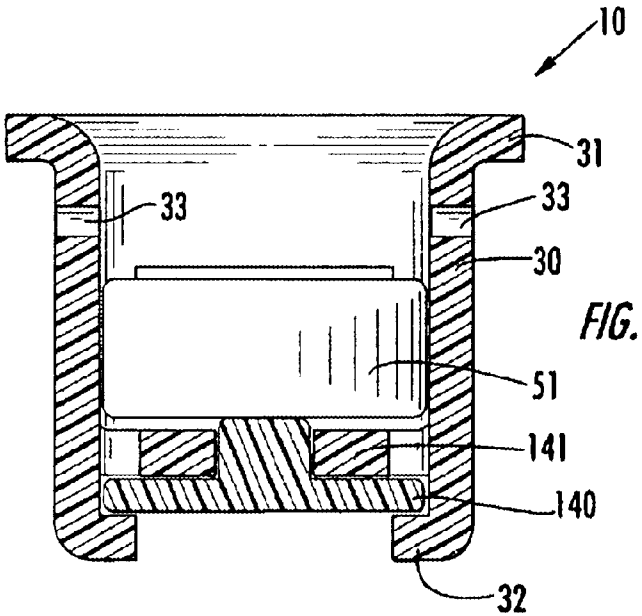
Figure 5A:
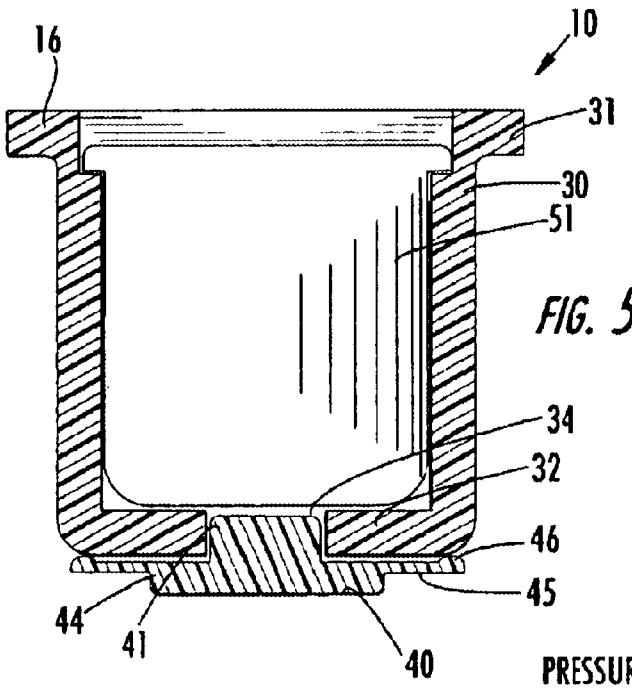
Figure 7:
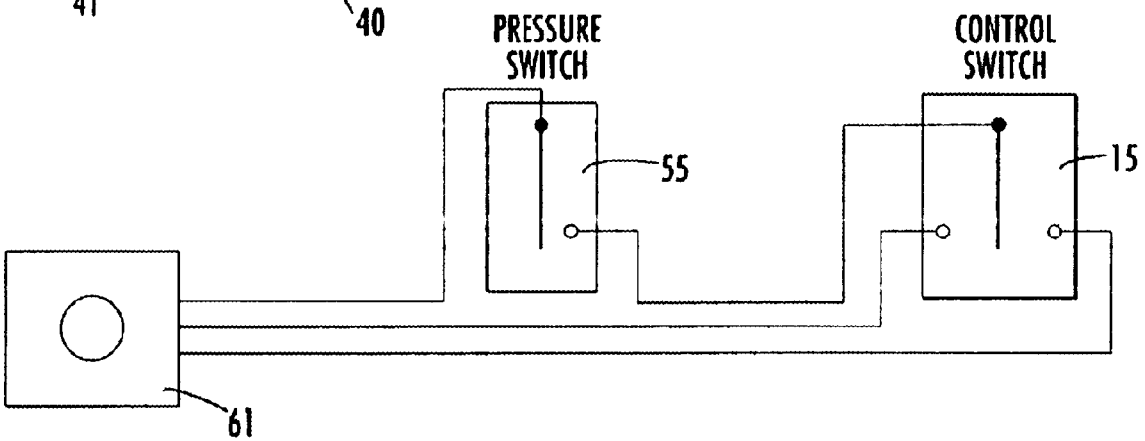
Figure 6:
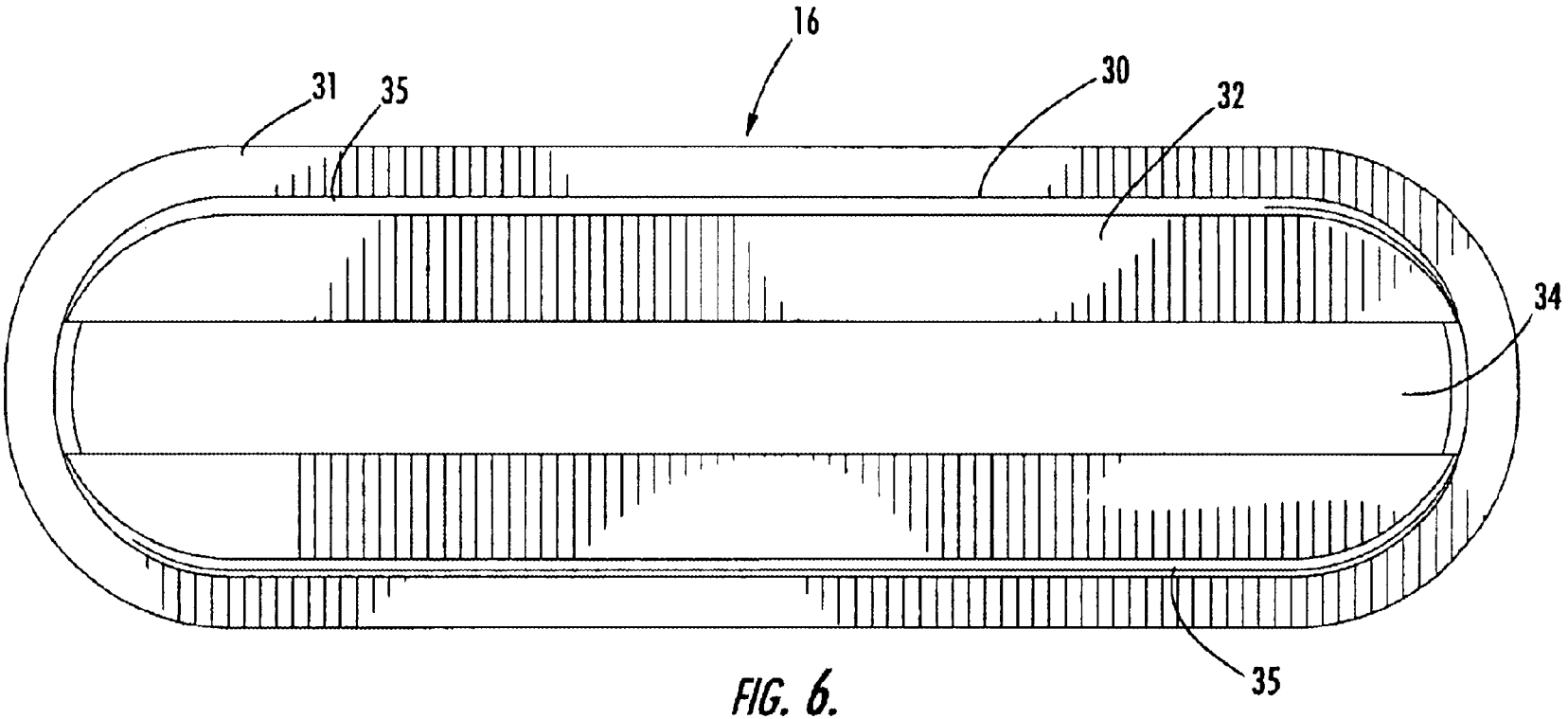
Figure 8:
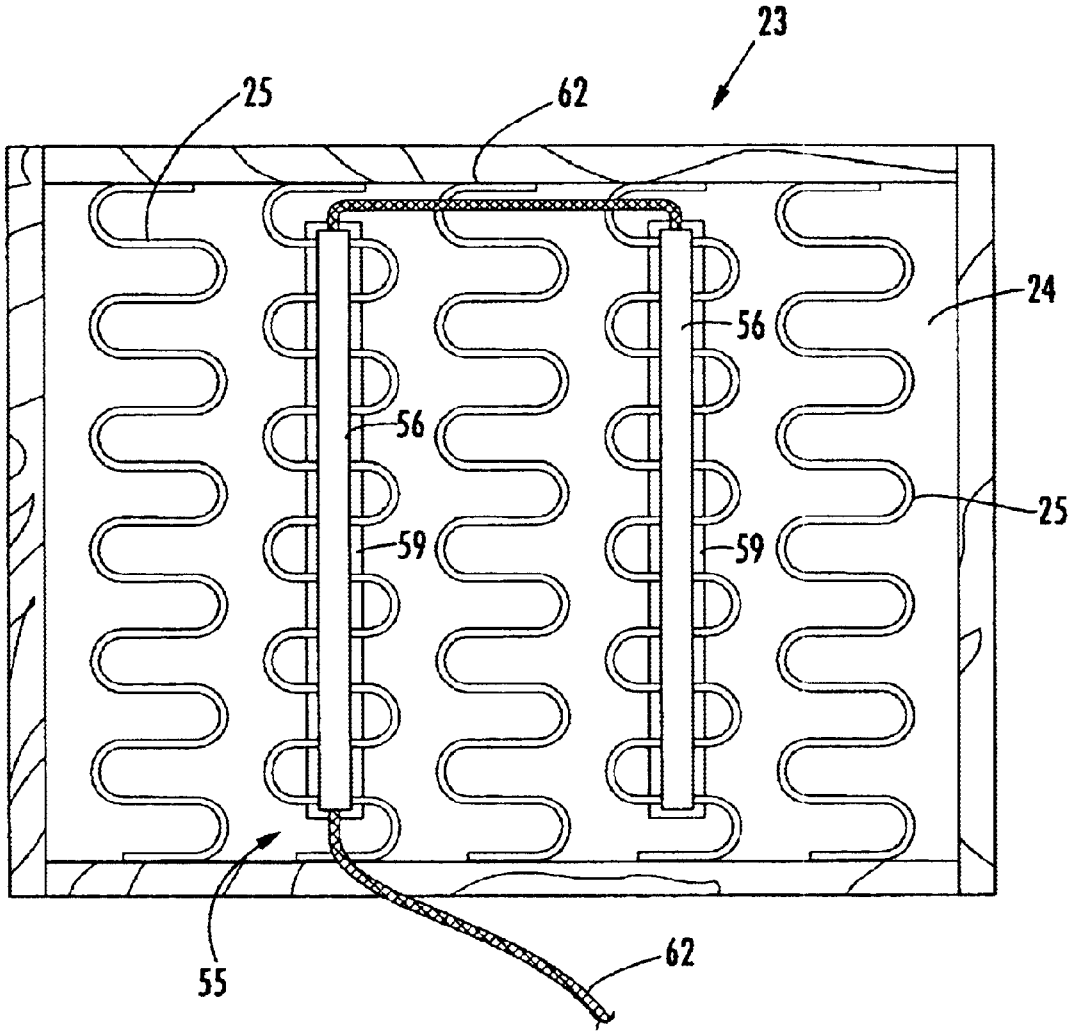
Figure 9:
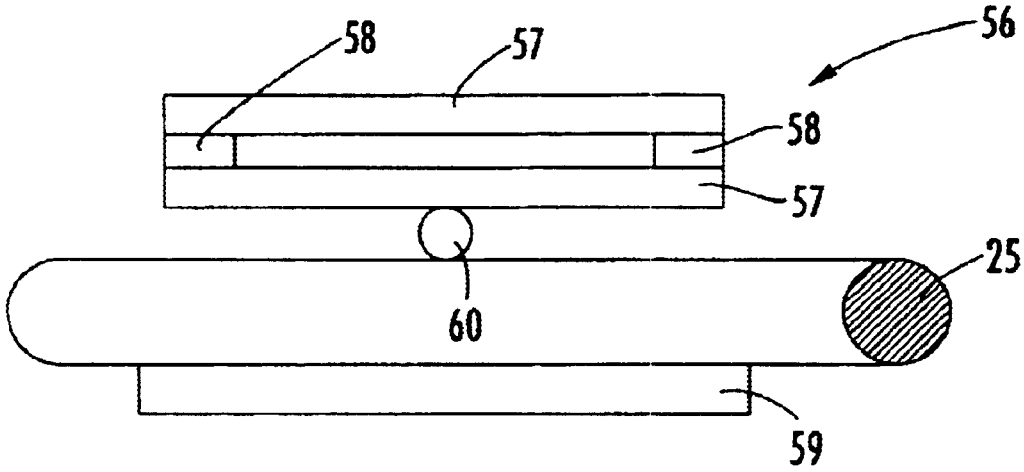
Figure 10:
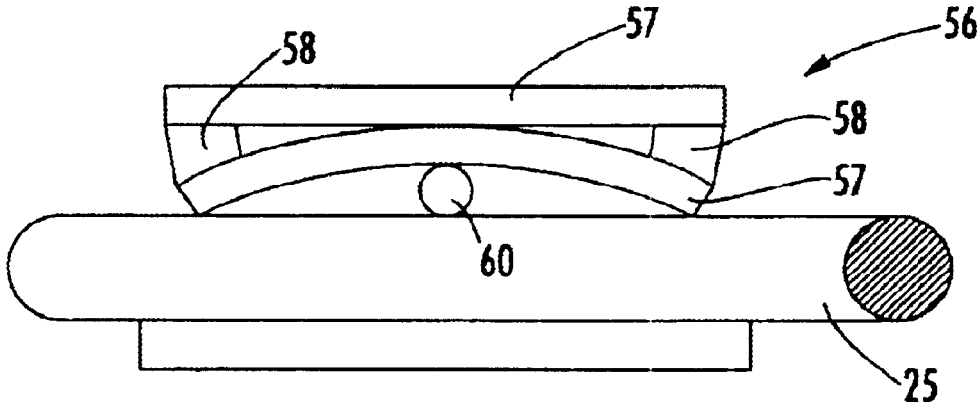

Having thus described the invention in general terms, reference will now be made to the accompanying drawings, which are not necessarily drawn to scale, and wherein:

FIG. 1 shows a plan view of a position controller assembly of one embodiment of the present invention;

FIG. 2 shows a side elevational view of a motorized reclining sofa of the present invention in an upright position and including the controller assembly shown in FIG. 1;

FIG. 3 shows a side elevational view of the motorized reclining sofa of FIG. 2 in a reclining position;

FIG. 4 shows perspective view of a sliding member of the switch assembly shown in FIG. 1;

FIG. 5A shows a cross-sectional view of a control switch and track of another embodiment of the controller assembly of the present invention;

FIG. 5B shows a cross-sectional view of a control switch and track of yet another embodiment of the controller assembly of the present invention;

FIG. 6 is a plan view of the bottom of a track of the controller assembly shown in FIG. 1;

FIG. 7 is an electrical diagram of another embodiment of a controller assembly of the present invention including a pressure switch;

FIG. 8 is a plan view of the pressure switch of FIG. 7 mounted on a seat base of the sofa shown in FIGS. 2 and 3;

FIG. 9 is a cross-sectional view of a contact strip of the pressure switch shown in FIG. 8; and FIG. 10 is a cross-section view of the strip of FIG. 9 deflected under loading.

DETAILED DESCRIPTION OF THE INVENTION

The present invention now will be described more filly hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will filly convey the scope of the invention to those skilled in the art. Like numbers refer to like elements throughout.

One embodiment of a position controller assembly 10 of the present invention is shown in FIG. 1. The controller assembly is fixed to the frame of a motorized, reclining sofa chair 11 having a backrest 12, a pair of armrests 13 and a footrest 14, as shown in FIG. 2. The controller assembly 10 includes a control switch 15 that is slidably mounted in a track 16 on a side of the chair 11, below one of the armrests 13. The control switch 15 controls motorized reclining of the backrest 12 and motorized extension of the footrest 14 via a footrest linkage 21, and slides in the track 16 to within reach of a sofa user even when the sofa chair 11 is in the fully reclined position, as shown in FIG. 3.

The motorized sofa chair also includes a seat cushion 20 disposed between the armrests 13 for the seating comfort of the sofa chair user. The seat cushion 20, backrest 12, pair of armrests 13 and footrest 14 are supported by a seat base 22. The seat base 22 includes a box-shaped wooden subframe 23, as shown in FIG. 8, which generally gives the seat base its rectangular shape and provides structural support for the other sofa chair 11 frame elements discussed above. The walls of the wooden subframe 23 define a seating area for supporting the seat cushion 20. A plurality of stretcher springs 25 span the seating area and have ends that abut, and are attached to, the front and back walls of the subframe 23. The stretcher springs 25 provide resilient support for the seat cushion and the sofa user. The footrest linkage 21 is motor powered to extend and retract the footrest 14 in response to activation of the control switch 15. Motorized sofa chairs and motor powered linkages for such chairs are known in the art and are therefore not described herein in further detail. The terms "chair," "sofa" and "motorized chair" are used interchangeably herein and are defined to include all types of furniture that have user-supporting surfaces that articulate using motor power. Preferably, the motorized chair of the present invention is upholstered for a pleasing aesthetic appearance.

The control switch 15 is supported by the track 16 and slides freely along the length of the track in a preferred direction generally parallel to the adjacent one of the armrests 13. The track includes an elongated wall structure 30 having a flange 31 at its peripheral, upper edge that provides a finished look that blends with the upholstered surface when the track is installed, as shown in FIGS. 2 and 3. The walls of the wall structure 30 are spaced apart a sufficient distance to contain the control switch 15 therebetween, but still allow the control switch to slide freely. The end portions of the wall structure 30 limit the sliding travel of the control switch 15. Preferably, the wall structure defines a plurality of attachment holes 33 that can be used to fix the track 16 to the frame of the sofa 11. The track 16 also includes a floor 32 attached to the bottom of the wall structure 30, as shown in FIG. 5A (of another embodiment). The floor 32 of the track defines an elongated slot 34 and the outer surface of the track floor includes a spaced pair of TEFLON bearing surfaces 35, as shown in FIG. 6.

The track 16 also includes an elongated, sliding member 40 that includes an elongate base portion 44, a raised center portion 41 and a pair of wing elements 45. The sliding member 40 is fixed to the control switch 15 and slides along the slot 34 defined by the floor 32 of the track 16. The base portion 44 has a long, rectangular shape. The raised center portion 41 also has a long, rectangular shape. The raised center portion is centered on the base portion 44, has the same length as the base portion, and about half of the width of the base portion. A pair of switch attachment holes 42 and a wiring aperture 43 are defined by the raised center portion 41. The wiring aperture 43 is centered on the raised center portion 41 and the switch attachment holes 42 are spaced across the wiring aperture, along the length of the raised center portion. The wing elements 45 are a pair of rectangular tabs that are spaced across, and extend from, the elongate sides of the base portion 44. A pair of bearing ridges 46 are formed on the outward, free edges of the wing elements 45.

As shown in FIGS. 1 and 5A, the sliding member 40 is aligned with the slot 34 defined by the floor 32. The top surface of the base portion 44 is adjacent to the underside of the floor and the raised center portion 41 extends through the slot 34. The bearing ridges 46 of the wing elements 45 contact the TEFLON bearing surfaces 35 along the edges of the outer surface of the floor 32. The bearing ridges 46 and the TEFLON bearing surfaces 35 provide a smooth sliding action and lateral stability for the sliding member 40. The sliding member 40 is held in the slot 34 by its attachment to the control switch 25. The control switch 15 includes a toggle 50 supported and housed within a rectangular base 51. The underside of the rectangular base is positioned flush against the inside surface of the floor 32. The control switch is fixed to the sliding member 40 via fasteners inserted through the switch attachment holes 42 and into the base 51 of the control switch 15. Such attachment couples the movement of the sliding member 40 and the control switch 15. The wiring of the control switch extends through the wiring aperture 43, allowing the wiring to slide with the toggle 50 and base 51, and is operably connected to a motor 61 of the motorized reclining chair 11, as shown in FIG. 7.

The controller assembly 10 preferably further includes a pressure switch assembly 55, as shown in FIG. 7, that disconnects the control switch 15 from the motor 61 when the user is not seated on the seat cushion 20 of the sofa 11. The pressure switch assembly 55 includes a pair of pressure switch strips 56 that are positioned along, and supported by, a corresponding pair of the stretcher springs 25, as shown in FIG. 8. The length and positioning of the strips 56 allows the pressure switch assembly 55 to sense the presence of the user seated in a variety of positions on the seat cushion 20. The strips 56 are each positioned along a respective one of the springs 25 to provide a hard surface on which to deflect the components of the strip. The pressure switch assembly 55 also includes a pair of electrical leads 62 that connect the strips 56 to a power source, the control switch 15 and the motor 61.

As shown in FIGS. 9 and 10, each strip includes a pair of metal contact strips 57 spaced apart by a pair of spacers 58 positioned between the metal contact strips. Each of the pressure switch strips 56 also includes a hook and loop (VELCRO) strip 59 and a contact wire 60. The contact wire is positioned under the pair of metal contact strips 57 and on top of the supporting one of the springs 25. The contact wire 60 acts as a pressure point that allows the metal contact strips 57 to be easily compressed together under loading to complete the circuit and allow control of the motor 61 using the control switch 15, as shown in FIG. 3. The loop or pile strip 59 is positioned under the supporting one of the springs 25 and, in the interstices of the spring defined by its sinusoidal shape, converges into contact with the underside of the bottom one of the metal contact strips 57. The bottom one of the metal contact strips has a pile or loop structure that attaches to the adjacent loop or pile strip 59. In this manner, the positioning of each of the pressure switch strips 56 is maintained during loading of the sofa chair 11 and movement of the seat cushion 20. Operation of the pressure switch assembly 55 is described in commonly assigned U.S. application Ser. No. 10/080,031 entitled "Pressure Switch for Motorized Chairs" filed on Feb. 21, 2002, which is hereby incorporated herein in its entirety by reference.

It should be noted that other types of pressure switch are usable with the present invention, including pressure sensors mounted under the subframe 23, or other, load bearing elements of the sofa chair 11. In addition, the track 16 could be located in other positions on the chair, such as on top of the armrest, and still allow the control switch 15 to move with the hand of the user through various positions obtainable by different types of motorized chair. It is also possible to vary the configuration of the control switch 15, such as with a pair of buttons in lieu of the toggle, and still be within the scope of the present invention.

The configuration (length, width, etc.) of the track 16 can be varied to account for such factors as different aesthetic appearances, switch types, ranges of chair motion, and reach of the user. For instance, two other embodiments of the control switch 15 and track 16 are shown in FIGS. 5A and 5B. In FIG. 5A, the base 51 of the control switch is tall enough that the toggle 50 is nearly flush with the top of the track 16 so as to be more easily reached by the user. FIG. 5B, shows an internal sliding member 140. The internal sliding member is held between the inside surface of the floor 32 and a retainer 141. The internal sliding member advantageously can reduce the risk of the sliding member becoming snagged on interior parts of the sofa chair 11.

During operation of the controller assembly 10, the user sits in the reclining sofa 11 while it is in the upright position and the toggle switch is positioned near the front of the chair, as shown in FIG. 2. As the user's weight is placed on the seat cushion 20, pressure is applied by the cushion onto the pressure switch assembly 55 resting on top of the springs 25. Pressure on one, or both, of the pressure switch strips 56 forces the metal contact strips 57 closed and completes the circuit between the control switch 15 and the motor 61.

Once the circuit to the control switch 15 is closed, the user extends their hand below one of the armrests 13 and uses a finger to depress the toggle 50 which starts the motor 61 and extends the linkage 21. As the linkage extends, it swings the footrest 14 attached thereto, up and out. Simultaneously, the backrest 12 reclines into the reclined position, as shown in FIG. 3. As the chair 11 moves into the reclining position, the user's hand remains on the control switch 15 and drags the control switch backwards, along the track 16. Advantageously, the movement of the control switch 15 coincides with the movement of the user's back and arm into the reclining position, maintaining the control switch within reach. To reassume the upright position, the user reverses the toggle 50 and slides the control switch 15 forward along the track while the footrest 14 is retracted and the backrest is moved to the upright position.

The present invention has several advantages. The user can reach the control switch 15 throughout a range of reclining positions, which prevents the user from becoming stuck in a prone position in the chair 11. The controller has a low, unobtrusive profile which is aesthetically pleasing, especially when surrounded by an upholstered surface. As the frame supports the track 16, the controller cannot be dropped or misplaced. The toggle switch 50 can be manipulated by hand and requires little exertion, which is ideal for elderly or disabled users. The pressure switch 55 avoids accidental movement of the chair when the weight of the user is not applied to one of the seating surfaces.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A motorized chair having user-supporting surfaces that are movable relative to each other and are controllable by a user sitting on the chair, said chair comprising:

a frame supporting at least two user-supporting surfaces that are movable relative to each other for positioning the user across a range of motion;

a motor connected to said frame and to the user-supporting surfaces for moving the user-supporting surfaces; and a position controller for controlling the motor, said position controller comprising a switch connected to the motor and movably supported on the frame so as to be traversable along the frame along a predetermined path by the user, said switch being operable in any position along said path, whereby the user can move the switch so as to remain within the reach of the user throughout the range of motion as the user-supporting surfaces of the chair are moved relative to each other.

2. A motorized chair of claim 1, further comprising a pressure switch connected to the position controller and operable in response to loading of one user-supporting surface to enable the position controller to control the motor.

3. A motorized chair of claim 2, wherein the pressure switch is also operable in response to unloading of one user-supporting surface to disable the position controller.

4. A motorized chair of claim 1, wherein the at least two user-supporting surfaces comprise a back supporting surface and a seating surface.

5. A motorized chair of claim 1, wherein the position controller further includes a track supported on the frame and wherein the switch is slidable in said track.

6. A motorized chair of claim 1, wherein the at least two user-supporting surfaces comprise a back supporting surface, a seat supporting surface and a footrest supporting surface.

7. A motorized chair of claim 1, wherein the switch is a toggle switch.

8. A motorized chair of claim 1, wherein a track is supported on the frame in a horizontal orientation.

9. A motorized chair of claim 1, wherein a track is supported on the frame in an orientation parallel to an armrest of the chair.

10. A motorized chair of claim 9, further comprising upholstery covering the frame and surrounding a periphery of the track.

11. A position controller for controlling a motorized chair, said motorized chair including a motor, at least two user-supporting surfaces and a frame, said user-supporting surfaces moveable relative to each other and said motorized chair controllable by a user sitting on the chair, said position controller comprising:

a track configured to be supported on the frame; and a switch configured for connection to the motor and supported in said track at a position reachable by the user, said switch being slidable in said track so that the switch remains within the reach of the user throughout the range of motion as the user-supporting surfaces of the chair are moved relative to each other wherein the switch is a toggle switch.

12. A position controller for controlling a motorized chair, said motorized chair including a motor, at least two user-supporting surfaces and a frame, said user-supporting surfaces moveable relative to each other and said motorized chair controllable by a user sitting on the chair, said position controller comprising:

a track configured to be supported on the frame;

a switch configured for connection to the motor and supported in said track at a position reachable by the user, said switch being slidable in said track so that the switch remains within the reach of the user throughout the range of motion as the user-supporting surfaces of the chair are moved relative to each other; and a pressure switch connected to the position controller and operable in response to loading of one user-supporting surface to enable the position controller to control the motor.

13. A position controller of claim 12, wherein the pressure switch is also operable in response to unloading of one user-supporting surface to disable the position controller.

* * * * *